US011817031B2

(12) United States Patent
Lee et al.

(10) Patent No.: US 11,817,031 B2
(45) Date of Patent: Nov. 14, 2023

(54) DISPLAY DEVICE AND METHOD OF OPERATING THE SAME

(71) Applicant: Samsung Display Co., Ltd., Yongin-si (KR)

(72) Inventors: Jinho Lee, Hwaseong-si (KR); Sungjae Park, Seongnam-si (KR); Seunghwan Park, Anyang-si (KR); Youngwoon Choi, Seoul (KR); Seungho Park, Suwon-si (KR); Kyoungho Lim, Hwaseong-si (KR); Namjae Lim, Yongin-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 17/940,429

(22) Filed: Sep. 8, 2022

(65) Prior Publication Data

US 2023/0162644 A1 May 25, 2023

(30) Foreign Application Priority Data

Nov. 19, 2021 (KR) ..... 10-2021-0160682

(51) Int. Cl.
*G09G 3/20* (2006.01)
*G09G 3/3225* (2016.01)
(Continued)

(52) U.S. Cl.
CPC ..... *G09G 3/2044* (2013.01); *G09G 3/2051* (2013.01); *G09G 3/2055* (2013.01);
(Continued)

(58) Field of Classification Search
CPC ..... G09G 3/2044; G09G 2310/027; G09G 2310/0278; G09G 2320/0247;
(Continued)

(56) References Cited

U.S. PATENT DOCUMENTS

2015/0379970 A1 12/2015 Albrecht et al.
2016/0171921 A1* 6/2016 Park ..... G09G 3/3208 345/77
(Continued)

FOREIGN PATENT DOCUMENTS

KR 1020190069667 A 6/2019
KR 1020190138718 A 12/2019

OTHER PUBLICATIONS

Extended European Search Report for Application No. 22208266.1-1210 dated Feb. 27, 2023.

*Primary Examiner* — Douglas M Wilson
(74) *Attorney, Agent, or Firm* — CANTOR COLBURN LLP

(57) ABSTRACT

A display device includes: a display panel including a plurality of pixels connected to a plurality of scan lines and a plurality of data lines, respectively; a scan driver, which provides a scan signal to the pixels through the scan lines; a data driver, which provides a data voltage to the pixels through the data lines; and a controller, which controls the scan driver and the data driver, and receives input image data at a variable input frame frequency. The controller determines whether a gray scale value of the input image data is included in any range of a first gray scale range and a second gray scale range different from the first gray scale range, and dithers the input image data when it is determined that the gray scale value of the input image data is included the first gray scale range.

20 Claims, 11 Drawing Sheets

(51) Int. Cl.
*G09G 3/3275* (2016.01)
*G09G 3/36* (2006.01)

(52) U.S. Cl.
CPC ..... *G09G 3/3225* (2013.01); *G09G 3/3275* (2013.01); *G09G 3/3685* (2013.01); *G09G 2310/027* (2013.01); *G09G 2310/0278* (2013.01); *G09G 2320/0247* (2013.01); *G09G 2320/0271* (2013.01); *G09G 2340/0435* (2013.01); *G09G 2360/16* (2013.01)

(58) Field of Classification Search
CPC ..... G09G 2340/0435; G09G 2360/16; G09G 3/2055; G09G 3/3225; G09G 3/2051; G09G 3/3275; G09G 3/3685; G09G 2320/0271
See application file for complete search history.

(56) References Cited

U.S. PATENT DOCUMENTS

| | | | | |
|---|---|---|---|---|
| 2016/0225305 | A1* | 8/2016 | Song | G09G 3/2055 |
| 2016/0314734 | A1* | 10/2016 | Albrecht | G09G 3/2055 |
| 2017/0092189 | A1* | 3/2017 | Hwang | G09G 3/3208 |
| 2019/0180695 | A1 | 6/2019 | Ha et al. | |

* cited by examiner

DISPLAY DEVICE AND METHOD OF OPERATING THE SAME

This application claims priority to Korean Patent Application No. 10-2021-0160682, filed on Nov. 19, 2021, and all the benefits accruing therefrom under 35 U.S.C. § 119, the content of which in its entirety is herein incorporated by reference.

BACKGROUND

1. Field

Embodiments provide generally to a display device. More particularly, embodiments relate to a display device supporting a variable frame mode and a method of operating the same.

2. Description of the Related Art

With the development of information technology, the importance of a display device, which is a connecting medium between a user and information, is being emphasized. For example, the use of the display device such as a liquid crystal display device, an organic light emitting display device, a plasma display device, and the like is increasing.

Meanwhile, the display device may display the number of frame images corresponding to the frame frequency per second. The display device may display a plurality of frame images at a predetermined frame frequency or may display a plurality of frame images in corresponding to a variable input frame frequency.

SUMMARY

However, when the display device displays a plurality of frame images corresponding to the variable input frame frequency, the luminance of a display panel driven at a first frame frequency and the luminance of a display panel driven at a second frame frequency may be different from each other. Accordingly, flicker may occur when the frame frequency of the display device is changed.

Embodiment provides a display device capable of improving image quality in a variable frame mode.

Embodiment provides a method of operating the display device.

A display device according to embodiments of the present invention includes: a display panel including a plurality of pixels connected to a plurality of scan lines and a plurality of data lines, respectively; a scan driver, which provides a scan signal to the pixels through the scan lines; a data driver, which provides a data voltage to the pixels through the data lines; and a controller, which controls the scan driver and the data driver, and receives input image data at a variable input frame frequency. The controller determines whether a gray scale value of the input image data is included in any range of a first gray scale range and a second gray scale range different from the first gray scale range, and dithers the input image data when it is determined that the gray scale value of the input image data is included the first gray scale range.

In an embodiment, the first gray scale range may be smaller than the second gray scale range.

In an embodiment, the controller may include: a gray scale determiner, which determines whether the gray scale value of the input image data is included in any range of the first gray scale range and the second gray scale range; a dithering processor, which dithers the input image data having a gray scale value included in the first gray scale range using dither patterns; and a memory, which stores the dither patterns corresponding to an image displayed on a display surface of the display panel, and provides the dither patterns to the dithering processor.

In an embodiment, the controller may further include: a frame frequency detector, which detects the variable input frame frequency and generates frame frequency information corresponding to the detected variable input frame frequency; and a data generator, which receives the dithered input image data and generates output image data by compensating the dithered input image data.

In an embodiment, each of the dither patterns may include a first gray scale area having a gray scale value greater than a target gray scale value to be displayed on a corresponding area of the display surface of the display panel and a second gray scale area having a gray scale value smaller than the target gray scale value to be displayed on a corresponding area the display surface of the display panel.

In an embodiment, the gray scale value of the first gray scale area and the gray scale value of the second gray scale area may have a gray scale difference of two or more.

In an embodiment, the target gray scale value may correspond to an average value of a gray scale value of the first gray scale area and a gray scale value of the second gray scale area.

A display device according to embodiments of the present invention includes: a display panel including a plurality of pixels connected to a plurality of scan lines and a plurality of data lines, respectively; a scan driver, which provides a scan signal to the pixels through the scan lines; a data driver, which provides a data voltage to the pixels through the data lines; and a controller, which controls the scan driver and the data driver, and receives input image data at a variable input frame frequency. The controller determines whether a gray scale value of the input image data is included in any range of a first gray scale range and a second gray scale range different from the first gray scale range, determines whether the input image data represents any pattern of a single-color pattern, a single pattern, and a mixed color pattern by using a histogram analysis result for the input image data, and dithers the input image data so that the input image data has any one of a first gray scale value and a second gray scale value different from the first gray scale value when it is determined that the gray scale value of the input image data is included the first gray scale range.

In an embodiment, the first gray scale range may be smaller than the second gray scale range.

In an embodiment, the controller may dither the input image data so that the input image data has the first gray scale value when it is determined that the input image data represents the single pattern, and may dither the input image data so that the input image data has the second gray scale value when it is determined that the input image data represents the mixed color pattern.

In an embodiment, the single pattern may represent a color in which two single colors are combined, and the mixed color pattern may represent a color in which a plurality of single colors, which are more than two colors, are combined.

In an embodiment, the second gray scale value may be greater than the first gray scale value.

In an embodiment, the controller may include: a gray scale determiner, which determines whether the gray scale value of the input image data is included in any range of the first gray scale range and the second gray scale range; a histogram determiner, which generates the histogram of the input image data and determine whether the input image data represents any pattern of the single pattern, the single pattern, and the mixed color pattern by using the histogram analysis result for the histogram; a dithering processor, which dithers the input image data having a gray scale value included in the first gray scale range using dither patterns; and a memory, which stores the dither patterns corresponding to an image displayed on a display surface of the display panel, and provides the dither patterns to the dithering processor.

In an embodiment, the controller may further include: a frame frequency detector, which detects the variable input frame frequency and generates frame frequency information corresponding to the detected variable input frame frequency and a data generator, which receives the dithered input image data and generates output image data by compensating the dithered input image data.

In an embodiment, each of the dither patterns may include a first gray scale area having a gray scale value greater than a target gray scale value to be displayed on a corresponding area of the display surface of the display panel and a second gray scale area having a gray scale value smaller than the target gray scale value to be displayed on a corresponding area of the display surface of the display panel.

In an embodiment, the gray scale value of the first gray scale area and the gray scale value of the second gray scale area may have a gray scale difference of two or more.

In an embodiment, the target gray scale value may correspond to an average value of a gray scale value of the first gray scale area and a gray scale value of the second gray scale area.

A method of operating a display device according to embodiments of the present invention includes: receiving input image data at a variable input frame frequency; determining whether a gray scale value of the input image data is included in any range of a first gray scale range and a second gray scale range different from the first gray scale range; and dithering the input image data having a gray scale value included in the first gray scale range, based on determining that the gray scale value of the input image data is included in the first gray scale range.

In an embodiment, the first gray scale range may be smaller than the second gray scale range.

In an embodiment, the dithering the input image data may include dithering the input image data having the gray scale value included in the first gray scale range using dither patterns, receiving the dithered input image data, and compensating the dithered input image data to generate output image data.

In a display device and a method of operating the same according to an embodiment of the present invention, a controller of the display device may receive input image data at a variable input frame frequency, determine whether a gray scale value of the input image data is included in any range of a first gray scale range and a second gray scale range different from the first gray scale range, and dither the input image data when it is determined that the gray scale value of the input image data is included the first gray scale range. Accordingly, the flicker of the display device when the variable input frame frequency is changed may be effectively minimized or reduced.

BRIEF DESCRIPTION OF THE DRAWINGS

Illustrative, non-limiting embodiments will be more clearly understood from the following detailed description in conjunction with the accompanying drawings.

DETAILED DESCRIPTION

Figure 1:
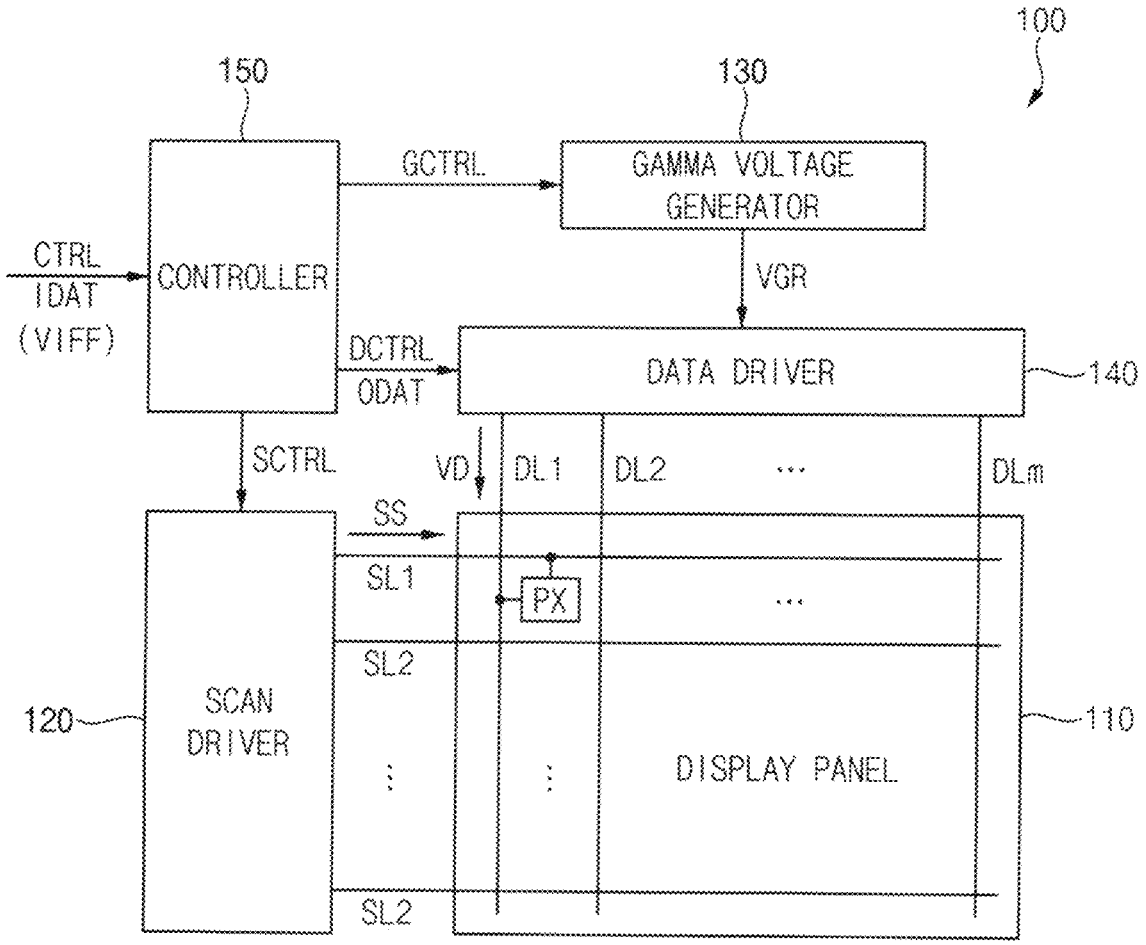
FIG. 1 is a block diagram illustrating a display device according to an embodiment.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Hereinafter, embodiments of the present disclosure will be explained in detail with reference to the accompanying drawings. The same reference numerals are used for the same components in the drawings, and redundant descriptions of the same components will be omitted.

FIG. 1 is a block diagram illustrating a display device according to an embodiment.

Referring to FIG. 1, the display device 100 according to an embodiment of the present invention may include a display panel 110 that includes a plurality of pixels PX, a scan driver 120 that provides a scan signal SS to the plurality of pixels PX, a gamma voltage generator 130 that generates a gamma reference voltages VGR, a data driver 140 that provides a data voltage VD to the plurality of pixels PX, and a controller 150 that controls the scan driver 120, the gamma voltage generator 130, and the data driver 140.

The display panel 110 may include a plurality of scan lines SL1 to SLn, a plurality of data lines DL1 to DLm, and the plurality of pixels PX (provided that n and m are integers greater than or equal to 2). Each of the scan lines SL1 to SLn may extend in a first direction (e.g., a row direction), and each of the data lines DL1 to DLm may extend in a second direction (e.g., a column direction) intersecting the first direction. The scan lines SL1 to SLn and the data lines DL1 to DLm may be insulated from each other. The plurality of pixels PX may be arranged in an area where the scan lines SL1 to SLn and the data lines DL1 to DLm intersect.

In an embodiment, each of the plurality of pixels PX may include a switching transistor that transmits the data voltage VD in response to the scan signal SS, a storage capacitor that stores the data voltage VD transmitted by the switching transistor, a driving transistor that generates a driving current based on the data voltage VD stored in the storage capacitor, and light emitting element that emits light based on the driving current generated by the driving transistor. For example, the light emitting element may include a light emitting diode ("LED"), an organic light emitting diode ("OLED"), a quantum dot light emitting element, and the like.

The scan driver 120 may provide the scan signals SS to the plurality of pixels PX through the plurality of scan lines SL1 to SLn based on a scan control signal SCTRL received from the controller 150. In an embodiment, the scan driver 120 may sequentially provide the scan signals SS to the plurality of pixels PX in row units. In addition, the scan control signal SCTRL may include a scan start signal, a scan clock signal, and the like, but is not limited thereto. For example, the scan driver 120 may be integrated or formed on a periphery of the display panel 110 in another embodiment. Alternatively, the scan driver 120 may be implemented with one or more integrated circuits ("IC") in still another embodiment.

The gamma voltage generator 130 may be controlled by a gamma control signal GCTRL from the controller 150 to generate one or more the gamma reference voltages VGR. In an embodiment, the gamma control signal GCTRL may indicate voltage levels of the gamma reference voltages VGR and the gamma voltage generator 130 may generate the gamma reference voltages VGR corresponding to the voltage levels indicated by the gamma control signal GCTRL. For example, the gamma voltage generator 130 may be located outside the data driver 140. Alternatively, the gamma voltage generator 130 may be included in the data driver 140.

The data driver 140 may receive a data control signal DCTRL and an output image data ODAT from the controller 150 and receive the gamma reference voltages VGR from the gamma voltage generator 130. The data driver 140 may provide the data voltages VD to the plurality of pixels PX through the plurality of data lines DL1 to DLm based on the data control signal DCTRL, the output image data ODAT, and the gamma reference voltages VGR. In an embodiment, the data driver 140 may generate each gray scale voltages corresponding to each gray scale level, select gray scale voltages corresponding to the output image data ODAT from among the gray scale voltages, and provide the selected gray scale voltages as the data voltages VD to the plurality of pixels PX based on the gamma reference voltages VGR. In addition, the data control signal DCTRL may include an output data enable signal, a horizontal start signal, a load signal, and the like, but is not limited thereto. For example, the data driver 140 may be implemented as a single integrated circuit, and the integrated circuit may be referred to as a timing controller embedded data driver ("TED") in another embodiment. Alternatively, the data driver 140 may be implemented as separate integrated circuits in still another embodiment.

The controller 150 may receive input image data IDAT and a control signal CTRL from an external host processor. For example, the controller 150 may be a timing controller, and the host processor may be an application processor ("AP"), a graphic processing unit ("GPU"), or a graphic card. In an embodiment, the input image data IDAT may be RGB image data including red image data, green image data, and blue image data. In addition, the control signal CTRL may include a vertical synchronization signal, a horizontal synchronization signal, an input data enable signal, a master clock signal, and the like, but is not limited thereto.

The controller 150 may generate the scan control signal SCTRL, the gamma control signal GCTRL, the data control signal DCTRL, and the output image data ODAT based on the input image data IDAT and the control signal CTRL. The controller 150 may control the operation of the scan driver 120 by providing the scan control signal SCTRL to the scan driver 120, control the operation of the gamma voltage generator 130 by providing the gamma control signal GCTRL to the gamma voltage generator 130, and control the operation of the data driver 140 by providing the output image data ODAT and the data control signal DCTRL to the data driver 140.

The host processor may provide the input image data IDAT to the display device 100 at a variable input frame frequency VIFF (or variable frame rate) by changing a time length of a blank period for every frame period, and the controller 150 may receive the input image data IDAT from the host processor at the variable input frame frequency VIFF. In an embodiment, the variable input frame frequency VIFF may be varied within a variable frequency range from a predetermined minimum frequency to a predetermined maximum frequency. For example, the minimum frequency may about 48 hertz (Hz), the maximum frequency may be about 240 Hz, and the variable frequency range of the variable input frame frequency VIFF may be about 48 Hz to about 240 Hz, but is not limited thereto.

The controller 150 may control the data driver 140 and the scan driver 120 to drive the display panel 110 at the variable input frequency VIFF. In an embodiment, a mode of the display device 100 in which the display panel 110 is driven at the variable input frame frequency VIFF may be referred to as a variable frame mode. For example, the variable frame mode may be a free-sync mode, a mouse-sync mode, a Q-sync mode, or the like, but is not limited thereto.

Figure 2:
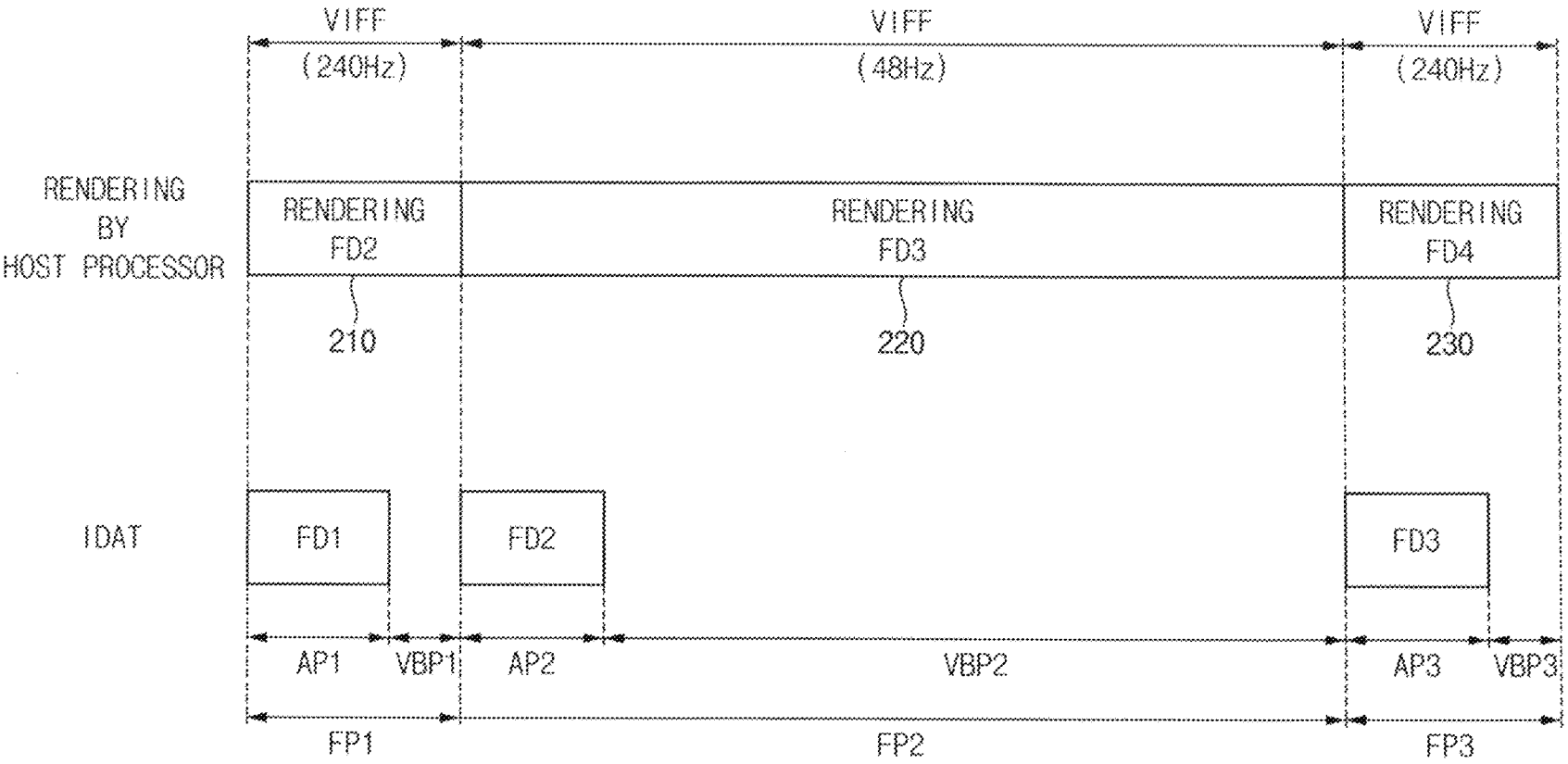
FIG. 2 is a timing diagram illustrating an example of an input image data input to the display device of FIG. 1 at a variable input frame frequency.

FIG. 2 is a timing diagram illustrating an example of an input image data input to the display device of FIG. 1 at a variable input frame frequency.

Referring to FIGS. 1 and 2, a period or frequency of the rendering 210, 220, and 230 of the external host processor may not be constant, and the host processor may provide the input image data IDAT, that is, a frame data FD1, FD2, and FD3 to the display device 100 by synchronizing with an irregular period or frequency of the rendering 210, 220, and 230 in the variable frame mode. That is, in the variable frame mode, each frame period FP1, FP2, and FP3 has a constant active period AP1, AP2, and AP3 having a constant time length, but the host processor may provide the frame data FD1, FD2, and FD3 at the variable frame frequency VIFF to the display device 100 by changing a time length of a variable blank period VBP1, VBP1, and VBP3 of each the frame period FP1, FP2, and FP3.

When the second frame data FD2 is rendered (210) at a frequency of about 240 Hz in the first frame period FP1, the host processor may provide the first frame data FD1 at the variable input frame frequency VIFF of about 240 Hz to the display device 100. In addition, the host processor may output the second frame data FD2 during the active period AP2 of the second frame period FP2, and continue the variable blank period VBP2 of the second frame period FP2 until the rendering (220) of the third frame data FD3 is completed. Accordingly, when the third frame data PD3 is rendered (220) at a frequency of about 48 Hz in the second frame period FP2, the host processor may provide the second frame data FD2 at the variable input frame frequency VIFF of about 48 Hz to the display device 100 by increasing the time of the variable blank period VBP2 of the second frame period FP2. When the fourth frame data FD4 is rendered (230) with a frequency of about 240 Hz again in the third frame period FP3, the host processor may provide the third frame data FD3 at the variable input frame frequency VIFF of about 240 Hz again to the display device 100.

That is, in the variable frame mode, the frame periods FP1, FP2, and FP3 may include the active periods AP1, AP2, and AP3 having a constant time length regardless of the variable input frame frequency VIFF and the variable blank periods VBP1, VBP2, and VBP3 having a variable time length corresponding to the variable input frame frequency VIFF, respectively. For example, in the variable frame mode, as the variable input frame frequency VIFF decreases, the time of the variable blank period VBP1, VBP2, and VBP3 may increase. In the variable frame mode, the controller 150 may output the input image data IDAT received at the variable input frame frequency VIFF as the output image data ODAT to the data driver 140 at a driving frequency substantially equal to the variable input frame frequency VIFF. Accordingly, the display device 100 supporting the variable frame mode may prevent a tearing phenomenon caused by a frame frequency mismatch by displaying an image in synchronization with the variable input frame frequency VIFF.

However, in a case where a data compensation (or a luminance compensation) according to the variable input frame frequency VIFF (i.e., the driving frequency of the display panel 110) is not performed in the variable frame mode, the luminance of the display panel 110 may be changed according to the variable input frame frequency VIFF (i.e., the driving frequency of the display panel 110). For example, in the case where the data compensation according to the variable input frame frequency VIFF is not performed in the variable frame mode, during the same time, the number of initializations of each pixel PX of the display panel 110 driven at a first frequency may be different from the number of initializations of each pixel PX of the display panel 110 driven at a second driving frequency different from the first driving frequency. Accordingly, a luminance of the display panel 110 driven at the first driving frequency may be different from a luminance of the display panel 110 driven at the second driving frequency.

Figure 3:
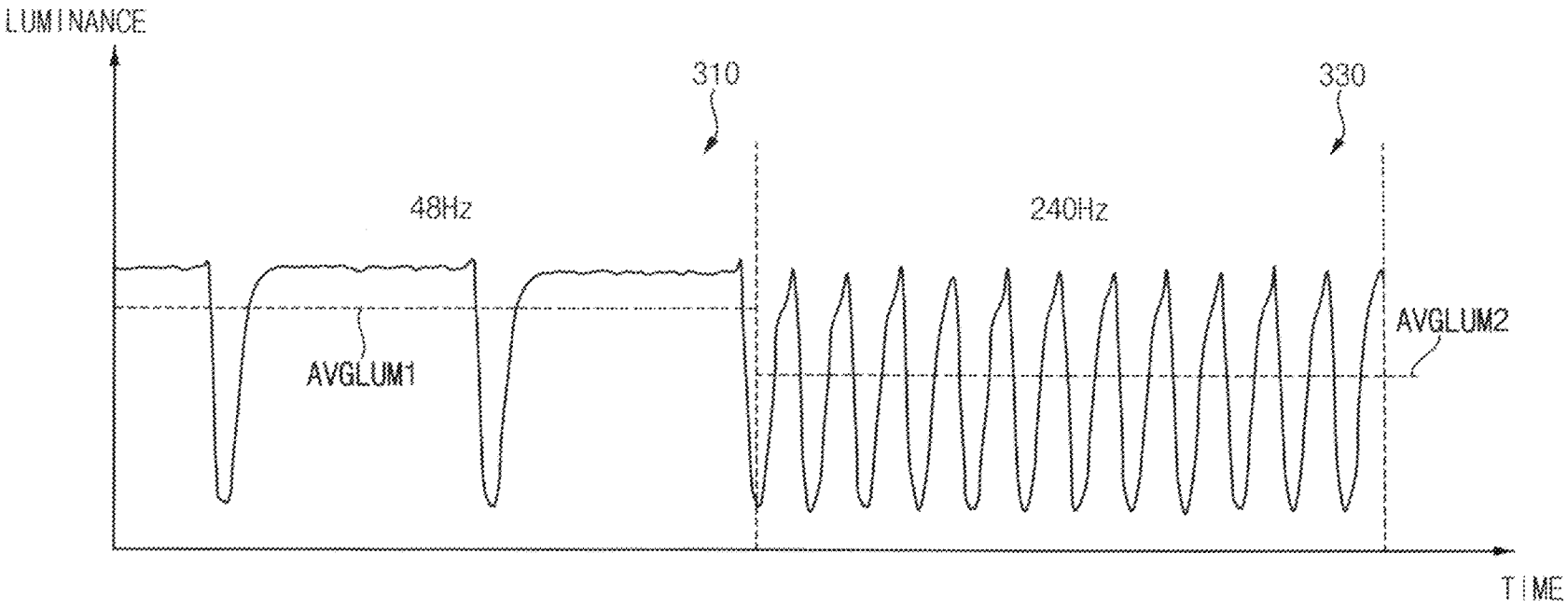
FIG. 3 is a diagram illustrating an example of luminance of a display panel driven at different frame frequencies in a case where data compensation is not performed.

FIG. 3 is a diagram illustrating an example of luminance of a display panel driven at different frame frequencies in a case where data compensation is not performed.

For example, FIG. 3 illustrates an example of a luminance 310 of the display panel 110 driven at a first driving frequency of about 48 Hz and an example of a luminance 330 of the display panel 110 driven at a second driving frequency of about 240 Hz Referring to FIGS. 1 and 3, in the case where the data compensation according to the variable input frame frequency VIFF is not performed, during the same time (e.g., about 53 milliseconds (ms)), each pixel PX of the display panel 110 driven with the first driving frequency of about 48 Hz may be initialized about 2.5 times and each pixel PX of the display panel 110 driven with the second driving frequency of about 240 Hz may be initialized about 13 times. Accordingly, an average luminance AVGLUM2 of the display panel 110 driven with the second driving frequency of about 240 Hz may be lower than an average luminance AVGLUM1 of the display panel 110 driven with the first driving frequency of about 48 Hz.

To remove or reduce a luminance difference of the display panel 110 according to the variable input frame frequency VIFF, that is, the driving frequency of the display panel 110, the display device 100 may perform the data compensation according to the variable input frame frequency VIFF.

Figure 4:
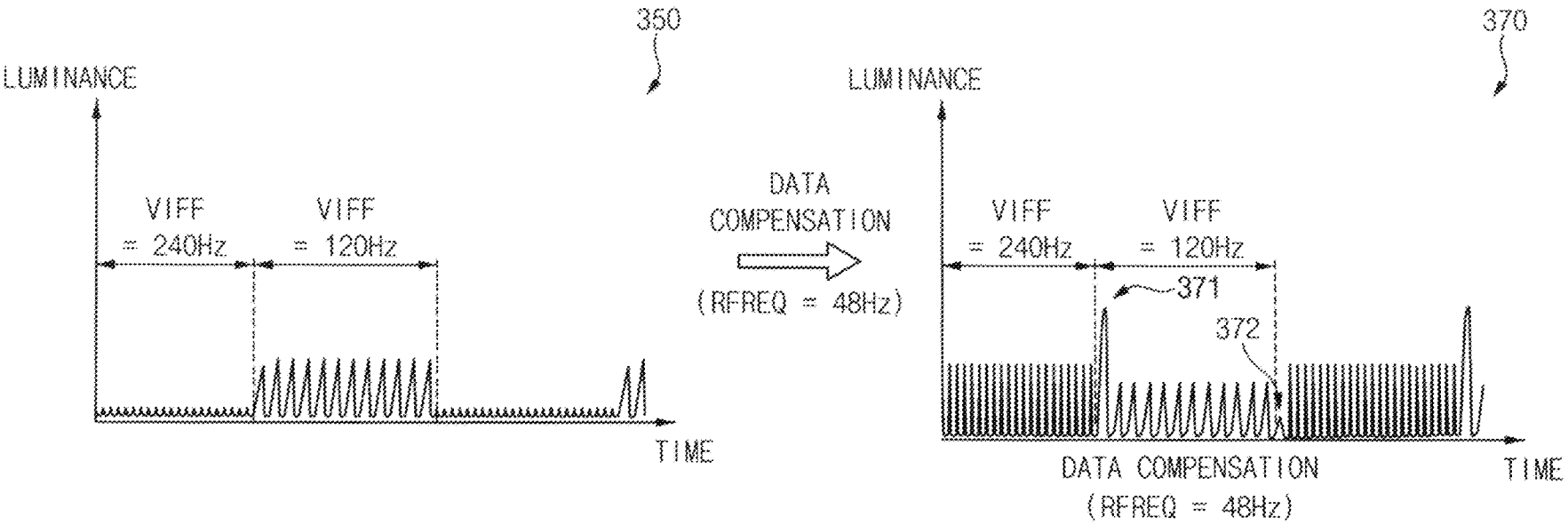
FIG. 4 is a diagram illustrating an example of luminance of a display panel in a case where data compensation is not performed and an example of luminance of a display panel in a case where data compensation is performed.

FIG. 4 is a diagram illustrating an example of luminance of a display panel in a case where data compensation is not performed and an example of luminance of a display panel in a case where data compensation is performed.

Referring to FIGS. 1 and 4, in a case 350 where the data compensation is not performed, an average luminance of the display panel 110 driven at the variable input frame frequency VIFF of about 240 Hz and an average luminance of the display panel 110 driven at the variable input frame frequency VIFF of about 120 Hz may be different from each other. However, in a case 370 where the data compensation is performed, an average luminance of the display panel 110 driven with the variable input frame frequency VIFF of about 240 Hz and an average luminance of the display panel 110 driven with the variable input frame frequency VIFF of about 120 Hz may be similar from each other.

A reference frequency RFREQ may be determined as a minimum frequency (e.g., about 48 Hz) of a frequency range of the variable input frame frequency VIFF, a reference luminance may be determined at the minimum frequency that is the reference frequency RFREQ, and the data compensation may be performed based on the reference luminance corresponding to the minimum frequency.

In this case, in a frame period with the variable input frame frequency VIFF, the data compensation may be performed based on an incorrect reference luminance, and the display panel 110 may have an unwanted luminance 371 and 372. That is, the variable input frame frequency VIFF of each frame period may be known when the frame period end (i.e., when a next frame period starts), thus the data compensation in the current frame period may be performed, corresponding to the variable input frame frequency VIFF of the previous frame period.

Accordingly, as shown at 370 in FIG. 4, in a frame period in which the variable input frame frequency VIFF is changed from about 240 Hz to about 120 Hz, the display panel 110 is driven at a driving frequency of about 120 Hz, but the data compensation is performed at the previous frequency of about 240 HZ, therefore, the display panel 110 may have the unwanted luminance 371. In addition, in a frame period in which the variable input frame frequency VIFF is changed from about 120 Hz to about 240 Hz, the display panel 110 is driven at a driving frequency of about 240 Hz, but the data compensation is performed at the previous frequency of about 120 HZ, therefore, the display panel 110 may have the unwanted luminance 372. In this case, flicker may occur in the display device 100.

The input image data IDAT provided at the variable input frame frequency VIFF may be dithered to reduce an occurrence of the flicker of the display device 100 due to the variable input frame frequency VIFF.

Accordingly, in the display device 100 according to an embodiment of the present invention, the controller 150 of the display device 100 may receive the input image data IDAT at the variable input frame frequency VIFF, determine whether a gray scale value of the input image data IDAT is included in any range of a first gray scale range and a second gray scale range different from the first gray scale range, and dither the input image data IDAT when it is determined that the gray scale value of the input image data IDAT is included the first gray scale range. Here, the first gray scale range may be smaller than the second gray scale range.

A visibility of the dithered input image data IDAT and an occurrence of the flicker of the display device 100 is a trade-off relationship. That is, as a visibility of the dithered input image data IDAT increases, the flicker of the display device 100 may be reduced. However, in a case where the dithered input image data IDAT represents a single color (e.g., red, green, blue, white, gray, or the like), a visibility of the dithered input image data IDAT may be increased, in this case, a display quality of the display device 100 may be reduced.

Accordingly, in a display device according to another embodiment of the present invention, a controller (e.g., a controller 151 of FIG. 9) of the display device 100 may receive the input image data IDAT at the variable input frame frequency VIFF, determine whether a gray scale value of the input image data IDAT is included in any range of the first gray scale range and the second gray scale range, determine whether the input image data IDAT represents any pattern of a single-color pattern, a single pattern, and a mixed color pattern by using a histogram analysis result for the input image data IDAT, and dither the input image data IDAT so that the input image data IDAT has any one of a first gray scale value and a second gray scale value different from the first gray scale value when it is determined that the gray scale value of the input image data IDAT is included the first gray scale range.

In an embodiment, for example, the single-color pattern may represent any one of red, green, blue, white, gray and black, the single pattern may represent a color in which two single colors (e.g., red, green, blue, white, gray, black, or the like) are combined, and the mixed color pattern may represent a color in which a plurality of single colors, which are more than two colors, (e.g., red, green, blue, white, gray, black, or the like) are combined. However, the color patterns according to the present invention is not limited thereto.

Specifically, the controller (e.g., a controller 151 of FIG. 9) of the display device 100 may dither the input image data IDAT so that the input image data IDAT has the first gray scale value when it is determined that the input image data IDAT represents the single pattern, and dither the input image data IDAT so that the input image data IDAT has the second gray scale value when it is determined that the input image data IDAT represents the mixed color pattern. On the other hand, the controller of the display device 100 may not dither the input image data IDAT when it is determined that the input image data IDAT represents the single-color pattern.

In an embodiment, the second gray scale value may be greater than the first gray scale value. For example, the first gray scale value may be about 4-gray, and the second gray scale value may be about 6-gray. However, the present invention is not limited thereto.

Figure 5:
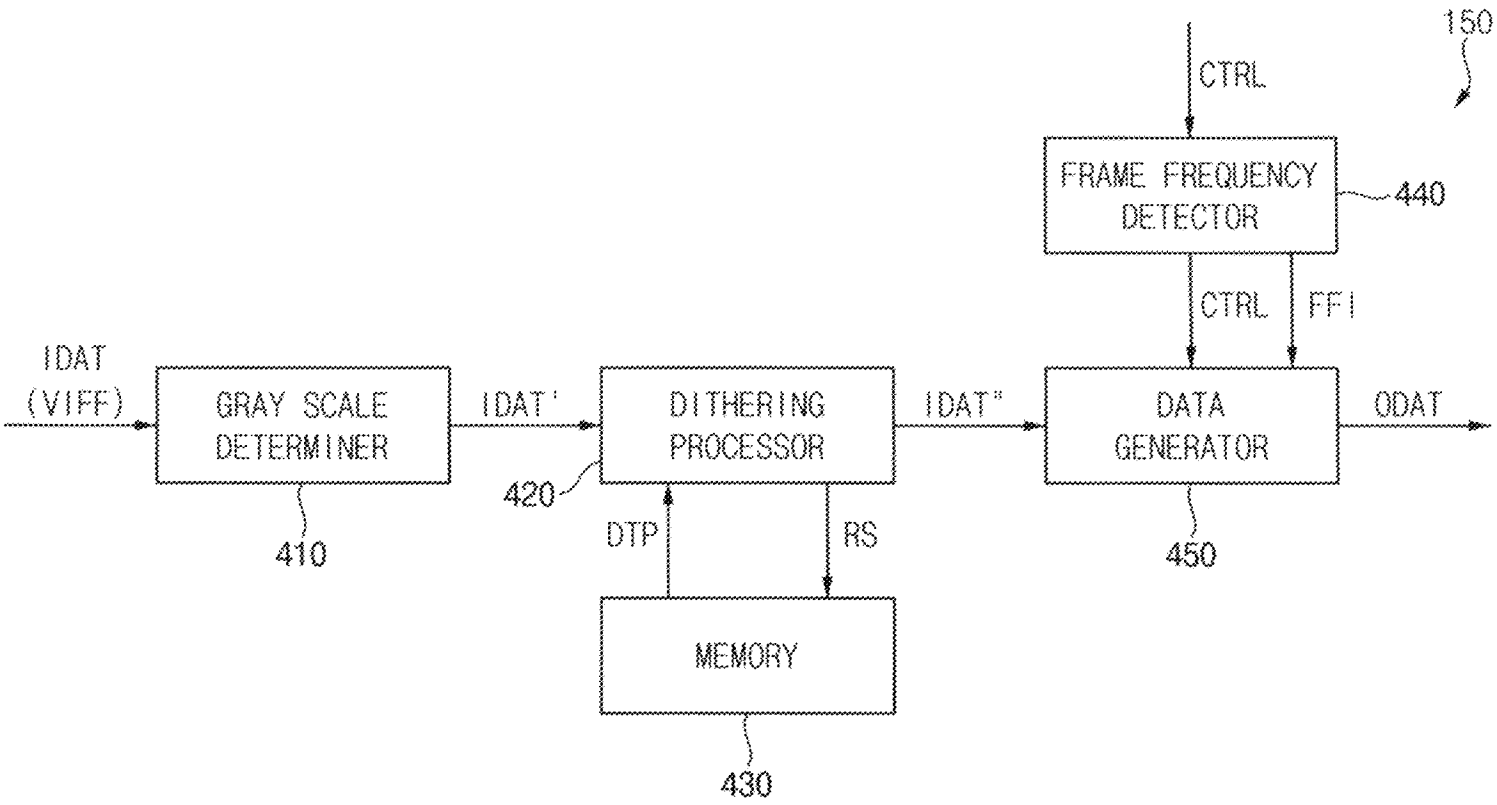
FIG. 5 is a block diagram illustrating a controller of the display device of FIG. 1.
Figure 6:
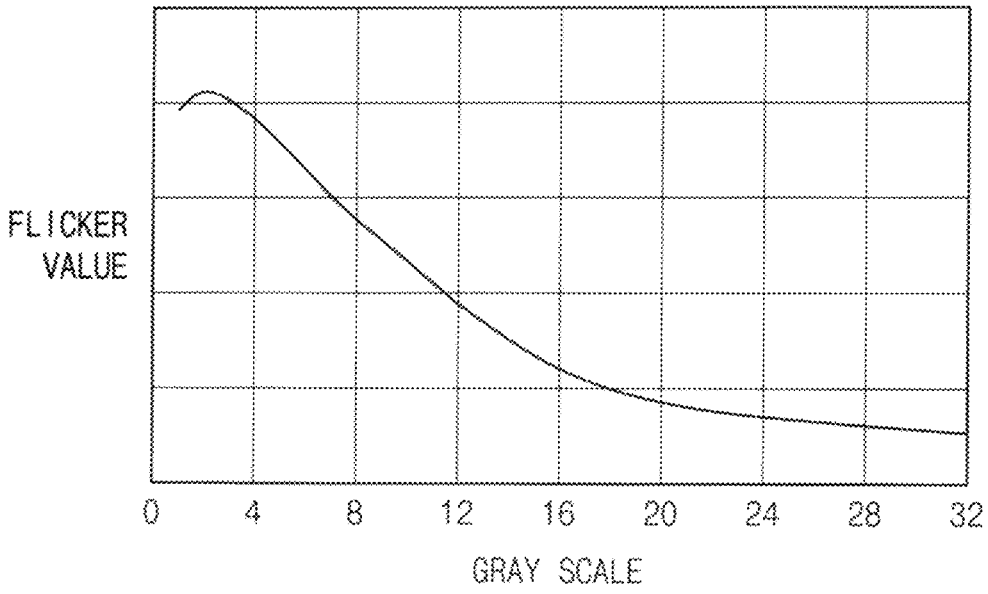
FIG. 6 is a diagram illustrating an example of a flicker value of a display device according to a gray scale value of input image data.

FIG. 5 is a block diagram illustrating a controller of the display device of FIG. 1. FIG. 6 is a diagram illustrating an example of a flicker value of a display device according to a gray scale value of input image data.

Referring to FIGS. 1 and 5, the controller 150 according to an embodiment of the present invention may include a gray scale determiner 410, a dithering processor 420, a memory 430, a frame frequency detector 440, and a data generator 450.

The gray scale determiner 410 may receive the input image data IDAT at the variable input frame frequency VIFF, and determine whether the gray scale value of the input image data IDAT is included in any range of the first gray scale range and the second gray scale range. The first gray scale range may be different from the second gray scale range. In an embodiment, the first gray scale range may be smaller than the second gray scale range. For example, the first gray scale range may be less than or equal to about 12-gray, and the second gray scale range may be greater than or equal to about 12-gray. However, the present invention is not limited thereto.

Referring to FIG. 6, it may be seen that the smaller the gray scale value of the input image data IDAT is, the larger the flicker value of the display device 100 is. On the other hand, it may be seen that the larger the gray scale value of the input image data IDAT is, the smaller the flicker value of the display device 100 is. That is, a visibility of the flicker may increase in a low gray scale area, and a visibility of the flicker may decrease in a high gray scale area. In other words, a dithering operation on the input image data IDAT may not be required in the high gray scale area.

Referring back to FIG. 5, the gray scale determiner 410 may determine whether a gray scale value of the input image data IDAT is included in any of the first gray scale range and the second gray scale range, and provide input image data IDAT' having a specific gray scale value to the dithering processor 420.

The dithering processor 420 may perform a dithering operation on the input image data IDAT' provided from the gray scale determiner 410. In an embodiment, when the input image data IDAT' has a gray scale value included in the first grayscale range, the dithering processor 420 may dither the input image data IDAT' using dither patterns DTP. On the other hand, when the input image data IDAT' is included in the second gray scale range, the dithering processor 420 may not dither on the input image data IDAT'. The dithering processor 420 may provide the dithered or non-dithered input image data IDAT" to the data generator 450.

The dithering processor 420 may request the dither patterns DTP from the memory 430 to perform a dithering operation. For example, the memory 430 may include a lookup table. The lookup table may store the dither patterns DTP corresponding to the input image data IDAT' having a gray scale value included in the first gray scale range. Accordingly, when a request signal RS is received from the dithering processor 420, the memory 430 may provide the dither patterns DTP on the input image data IDAT' having a gray scale value included in the first grayscale range to the dithering processor 420.

The frame frequency detector 440 may detect the variable input frame frequency VIFF by using the control signal CTRL. For example, the control signal CTRL may include a vertical synchronization signal, a horizontal synchronization signal, and the like. The frame frequency detector 440 may detect the variable input frame frequency VIFF by counting a horizontal synchronization signal received after one vertical synchronization signal is received until just before the next vertical synchronization signal is received. The frame frequency detector 440 may generate frame frequency information FFI based on the detected variable input frame frequency VIFF. For example, the frame frequency information FFI may include information on the number of frame images displayed per second.

The data generator 450 may receive the input image data IDAT", the control signal CTRL, and the frame frequency information FFI, and generate the output image data ODAT based on the input image data IDAT", the control signal CTRL, and the frame frequency information FFI. The data generator 450 may classify the input image data IDAT" in units of frames according to a vertical synchronization signal, and generate the output image data ODAT by classifying the input image data IDAT" in units of scan lines (e.g., the scan lines SL1 to SLn of FIG. 1) according to a horizontal synchronization signal. In addition, the data generator 450 may generate the output image data ODAT by compensating the input image data IDAT".

Figure 7:
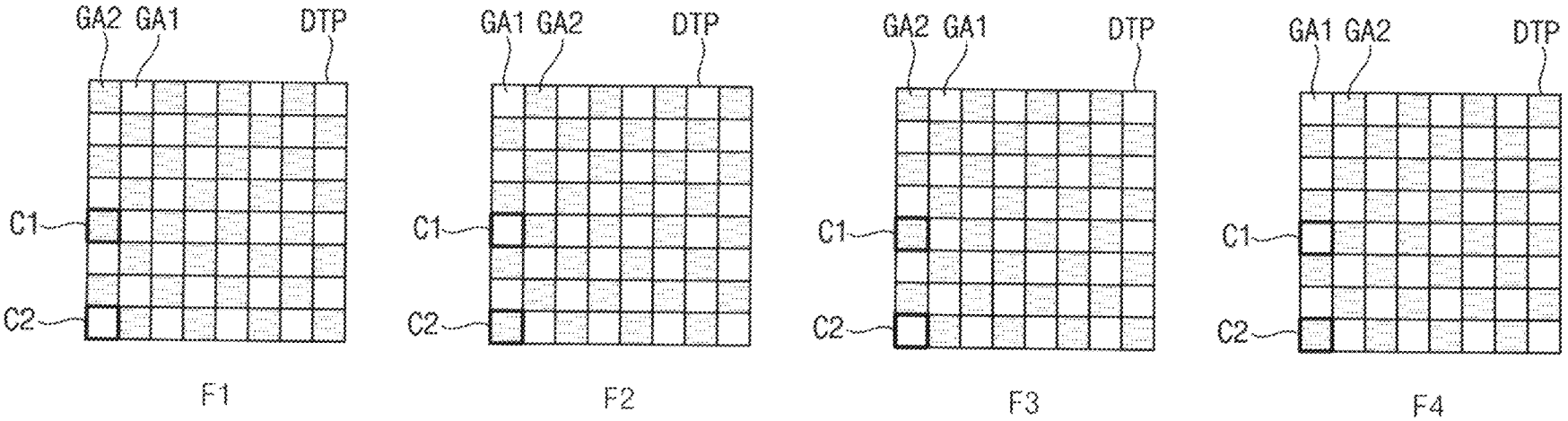
FIG. 7 is a diagram illustrating a dither pattern corresponding to a display surface of a display panel of FIG. 1 in units of frame period.
Figure 8A:
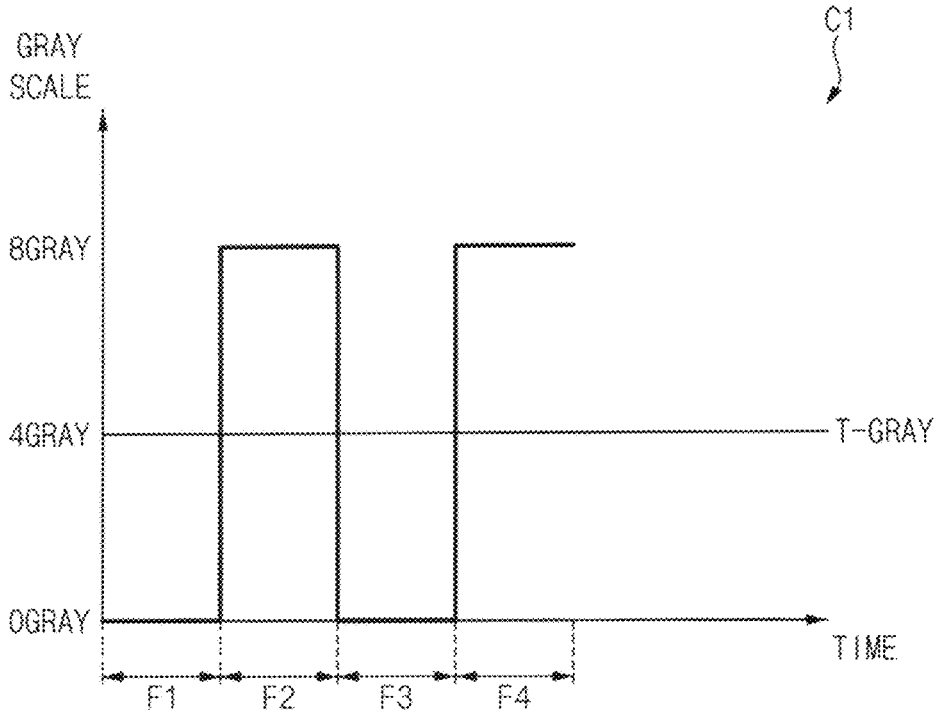
FIG. 8A is a diagram illustrating a gray scale value of a first portion of FIG. 7 in units of frame period.
Figure 8B:
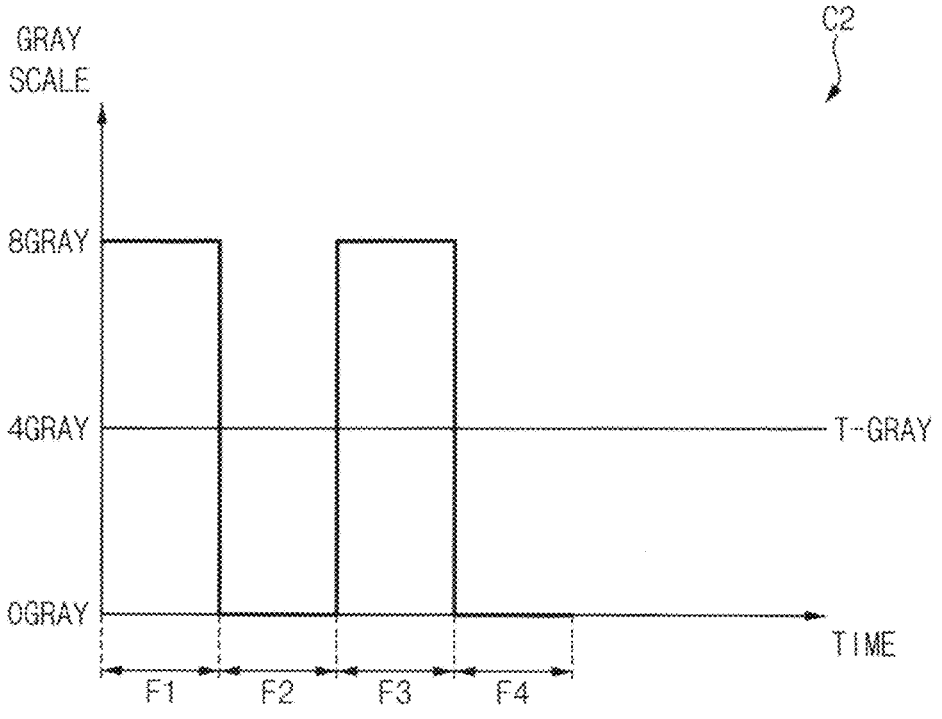
FIG. 8B is a diagram illustrating a gray scale value of a second portion of FIG. 7 in units of frame period.

FIG. 7 is a diagram illustrating a dither pattern corresponding to a display surface of a display panel of FIG. 1 in units of frame period. FIG. 8A is a diagram illustrating a gray scale value of a first portion of FIG. 7 in units of frame period. FIG. 8B is a diagram illustrating a gray scale value of a second portion of FIG. 7 in units of frame period.

Referring to FIGS. 1, 5, and 7, the plurality of dither patterns DTP may correspond to an image displayed on the display surface of the display panel 110. For example, each of the dither patterns DTP may include 8×8 gray scale areas. However, the configuration of the dither patterns DTP according to the present invention is not limited thereto, and each of the dither patterns DTP may include N×N gray scale areas (where N is a natural number equal to or greater than 1) in another embodiment.

As described above, the plurality of spatially dispersed dither patterns DTP may be set to correspond to the image displayed on the display surface of the display panel 110. However, the configuration of the dither patterns DTP according to the present invention is not limited thereto, and one dither pattern DTP may be set to have a size corresponding to the image displayed on the display surface of the display panel 110 in another embodiment.

The plurality of gray scale areas provided in each of the dither patterns DTP may be divided into a first gray scale area GA1 and a second gray scale area GA2. The first gray scale area GA1 may be defined as an area having a gray scale value greater than a target gray scale value to be displayed on a corresponding area of the display surface of the display panel 110. The second gray scale area GA2 may be defined as an area having a gray scale value smaller than a target gray scale value to be displayed on a corresponding area of the display surface of the display panel 110. Accordingly, a gray scale difference between the first gray scale area GA1 and the second gray scale area GA2 may be greater than 1-gray. In an embodiment, an average value of the gray scale value of the first gray scale area GA1 and the gray scale value of the second gray scale area GA2 may be the same as the target gray scale value.

The first and second gray scale areas GA1 and GA2 of each of the dither patterns DTP may have different arrangement structures according to a predetermined time. For example, the first and second gray scale areas GA1 and GA2 of each of the dither patterns DTP may have a different arrangement structure in units of one frame period.

During a first frame period F1, the dither pattern DTP may have a first pattern structure. For example, a first portion C1 of the dither pattern DTP may be set as the second gray scale area GA2 during the first frame period F1, and a second portion C2 of the dither pattern DTP may be set as the first gray scale area GA1 during the first frame period F1.

During a second frame period F2, the dither pattern DTP may have a second pattern structure different from the first pattern structure. For example, the first portion C1 of the dither pattern DTP may be set as the first gray scale area GA1 during the second frame period F2, and the second portion C2 of the dither pattern DTP may be set as the second gray scale area GA2 during the second frame period F2.

During a third frame period F3, the dither pattern DTP may have the first pattern structure. That is, during the first and third frame periods F1 and F3, the dither pattern DTP may have the same pattern structure. For example, the first portion C1 of the dither pattern DTP may be set as the second gray scale area GA2 during the third frame period F3, and the second portion C2 of the dither pattern DTP may be set as the first gray scale area GA1 during the third frame period F3.

During a fourth frame period F4, the dither pattern DTP may have the second pattern structure. That is, during the second and fourth frame periods F2 and F4, the dither pattern DTP may have the same pattern structure. For example, the first portion C1 of the dither pattern DTP may be set as the first gray scale area GA1 during the fourth frame period F4, and the second portion C2 of the dither pattern DTP may be set as the second gray scale area GA2 during the fourth frame period F4.

However, the configuration of the pattern structure of the dither pattern DTP according to the present invention is not limited thereto, and the dither pattern DTP may have different pattern structures during successive the first, second, third, and fourth frame periods F1, F2, F3, and F4, respectively in another embodiment.

Referring to FIGS. 7, 8A, and 8B, for example, when a target gray scale value T-gray of the dither pattern DTP is about 4-gray, the first gray scale area GA1 may have a gray scale value (e.g., about 8-gray) greater than the target gray scale value T-gray, and the second gray scale area GA2 may have a gray scale value (e.g., about 0-gray) smaller than the target grayscale value T-gray. That is, the first gray scale area GA1 and the second gray scale area GA2 may have a gray scale difference of about 8-gray.

In this case, the first portion C1 may have about 0-gray during the first and third frame periods F1 and F3 and have about 8-gray during the second and fourth frame periods F2 and F4. The second portion C2 may have about 8-gray during the first and third frame periods F1 and F3 and have about 0-gray during the second and fourth frame periods F2 and F4.

As described above, by dithering the input image data IDAT provided at the variable input frame frequency VIFF using the temporally and spatially dispersed dither patterns DTP, an occurrence of flicker of the display device 100 may be reduced.

Figure 9:
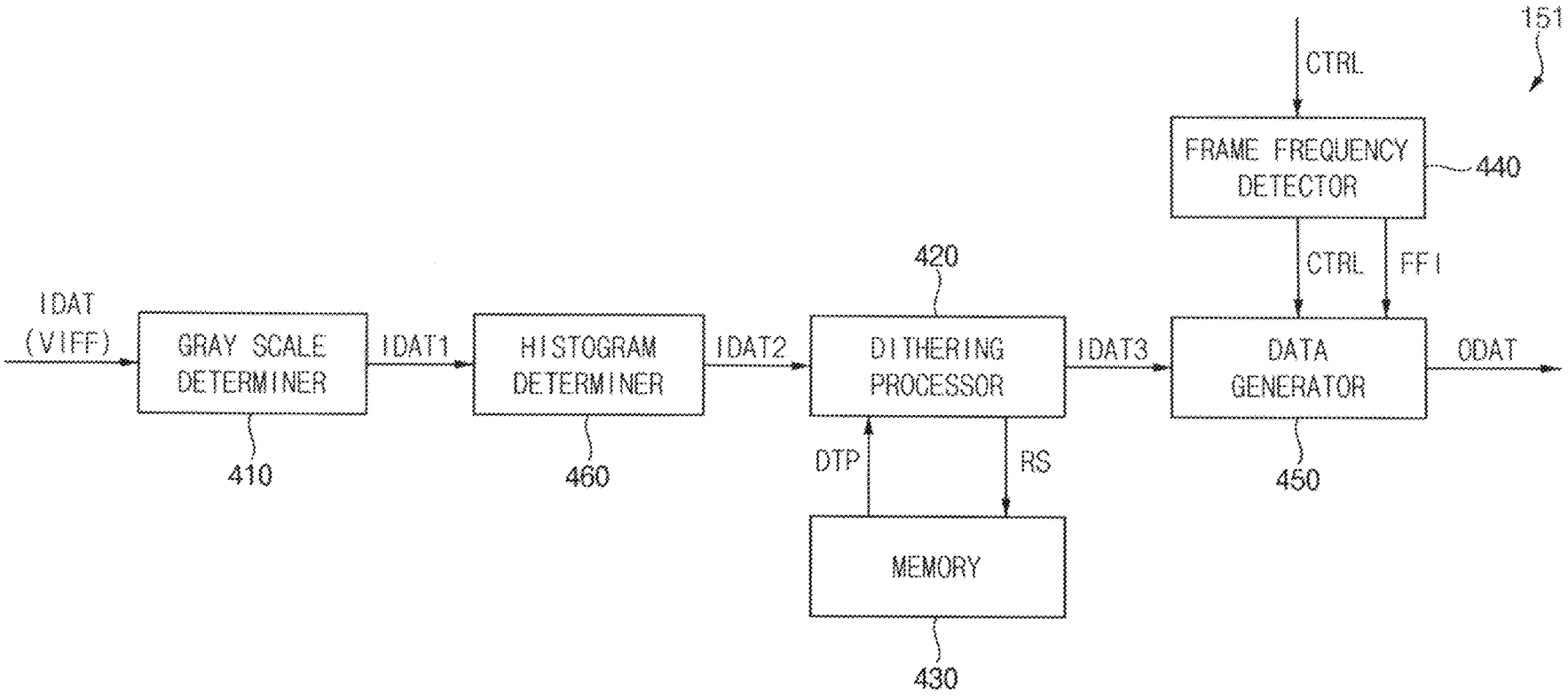
FIG. 9 is a block diagram illustrating a controller of a display device according to another embodiment.
Figure 10:
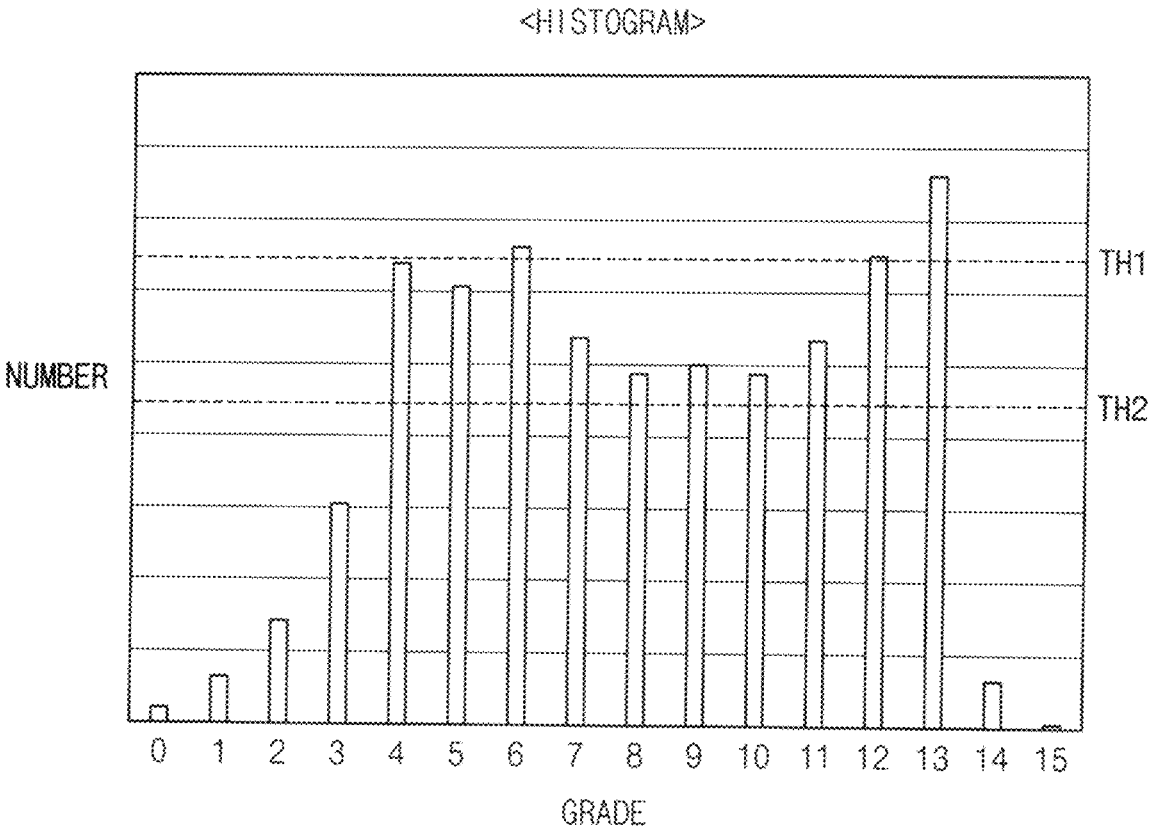
FIG. 10 is a diagram for explaining a histogram determiner of FIG. 9.

FIG. 9 is a block diagram illustrating a controller of a display device according to another embodiment. FIG. 10 is a diagram for explaining a histogram determiner of FIG. 9. For example, FIG. 10 is a diagram illustrating a histogram of the input image data IDAT on one frame period.

Referring to FIGS. 1, 9, and 10, the controller 151 according to another embodiment of the present invention may include the gray scale determiner 410, the dithering processor 420, the memory 430, the frame frequency detector 440, the data generator 450, and a histogram determiner 460. However, the controller 151 described with reference to FIG. 9 may be substantially the same as or similar to the controller 150 described with reference to FIG. 5 except that the histogram determiner 460 is further included. Hereinafter, overlapping descriptions will be omitted.

As described above, the gray scale determiner 410 may receive the input image data IDAT at the variable input frame frequency VIFF, and determine whether a gray scale value of the input image data IDAT is included in any range of the first gray scale range and the second gray scale range. In an embodiment, the first gray scale range may be smaller than the second gray scale range.

The gray scale determiner 410 may determine whether a gray scale value of the input image data IDAT is included in any range of the first gray scale range and the second gray scale range, and provide input image data IDAT1 having a specific gray scale value to the histogram determiner 460.

The histogram determiner 460 may generate a histogram of the input image data IDAT1, and determine whether the input image data IDAT1 represents any pattern of the single-color pattern, the single pattern, and the mixed color pattern by using the histogram analysis result. In an embodiment, the single pattern may represent a color in which two single colors are combined, and the mixed color pattern may represent a color in which a plurality of single colors, which are more than two colors, are combined. The histogram determiner 460 may provide the input image data IDAT2 representing a specific pattern to the dithering processor 420.

The histogram determiner 460 may generate the histogram by dividing a gray scale values of the input image data IDAT1 into 16 grades and counting the input image data IDAT1 included in a gray scale range of each grade. For example, a gray scale range of the input image data IDAT1 may be about 0-gray to about 255-gray, and the entire gray scale may be divided into 16 grades.

The histogram determiner 460 may analyze the number of the input image data IDAT1 (e.g., the number of pixels emitting the light in the gray scale range) corresponding to each grade. For example, the histogram determiner 460 may select three grades in an order of the number of the input image data IDAT1 being large by analyzing the number of the input image data IDAT1 corresponding to each grade and compare a sum of the number of the input image data IDAT1 corresponding to the three grades with a specific threshold value by calculating the sum of the number of the input image data IDAT1 corresponding to the three grades.

If it is determined that the sum of the number of the input image data IDAT1 corresponding to the three grades is larger than a first threshold value TH1 through the histogram, the input image data IDAT1 may represent the single pattern, and if it is determined that the sum of the number of input image data IDAT1 corresponding to the three grades is less than a second threshold value TH2 through the histogram, the input image data IDAT1 may represent the mixed color pattern. For example, the first threshold value TH1 may be greater than the second threshold value TH2.

In an embodiment, for example, when the input image data IDAT1 represents the single pattern in a first frame period, the histogram determiner 460 may generate a histogram for the input image data IDAT1 in a second frame period. If it is determined in the second frame period that sum of the number of input image data IDAT1 corresponding to the three grades is less than the first threshold value TH1 and is larger than the second threshold value TH2, using the histogram analysis result of the input image data IDAT1, the input image data IDAT1 may maintain the pattern of the first frame period in the second frame period. However, when a load change amount of the input image data IDAT1 is large in the second frame period, the input image data IDAT1 may represent the mixed color pattern in the second frame period. That is, when the load change amount of the input image data IDAT1 is large in the second frame period, a pattern of the input image data IDAT1 may be changed.

In an embodiment, for example, when the input image data IDAT1 represents the mixed color pattern in the first frame period, the histogram determiner 460 may generate a histogram for the input image data IDAT1 in the second frame period. If it is determined in the second frame period that sum of the number of input image data IDAT1 corresponding to the three grades is less than the first threshold value TH1 and is larger than the second threshold value TH2 using the histogram analysis result of the input image data IDAT1, the input image data IDAT1 may maintain the pattern of the first frame period in the second frame period. However, when a load change amount of the input image data IDAT1 is large in the second frame period, the input image data IDAT1 may represent the single pattern. That is, when the load change amount of the input image data IDAT1 is large in the second frame period, a pattern of the input image data IDAT1 may be changed.

When the input image data DAT2 is included in the first gray scale range, the dithering processor 420 may dither the input image data DAT2 using the dithered patterns DTP. On the other hand, the dithering processor 420 may not dither on the input image data DAT2 when the input image data DAT2 is included in the second gray scale range.

In addition, the dithering processor 420 may dither the input image data DAT2 representing the single pattern or the mixed color pattern. On the other hand, the dithering processor 420 may not dither the input image data DAT2 representing the single-color pattern.

In an embodiment, when the input image data DAT2 represents the single pattern, the dithering processor 420 may dither the input image data DAT2 so that the input image data DAT2 has the first gray scale value. When the input image data DAT2 represents the mixed color pattern, the dithering processor 420 may dither the input image data DAT2 so that the input image data DAT2 has the second gray scale value greater than the first gray scale value.

The dithering processor 420 may provide the input image data IDAT3 representing the single pattern, the mixed color pattern, or the single-color pattern to the data generator 450.

As used in connection with various embodiments of the disclosure, each of the gray scale determiner 410, the frame frequency detector 440, the data generator 450, and the histogram determiner 460 may be implemented in hardware, software, or firmware, for example, implemented in a form of an application-specific integrated circuit (ASIC).

Figure 11:
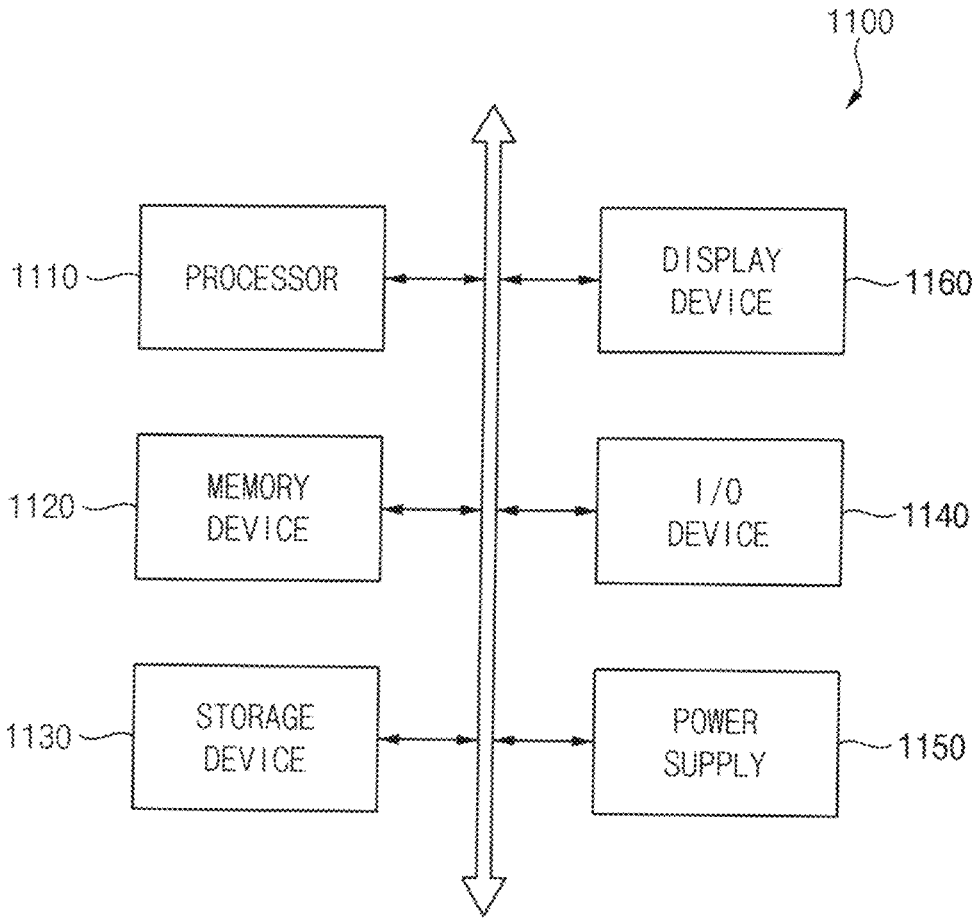
FIG. 11 is a block diagram illustrating an electronic device including the display device of FIG. 1.

FIG. 11 is a block diagram illustrating an electronic device including the display device of FIG. 1. For example, the display device 1160 illustrated in FIG. 10 may correspond to the display device 100 illustrated in FIG. 1.

Referring to FIG. 13, the electronic device 1100 may include a processor 1110, a memory device 1120, a storage device 1130, an input/output ("I/O") device 1140, a power supply 1150, and the display device 1160. The electronic device 1100 may further include a plurality of ports for communicating with a video card, a sound card, a memory card, a universal serial bus ("USB") device, other electronic devices, and the like.

The processor 1110 may perform various computing functions or tasks. The processor 1110 may be an application processor (AP), a micro-processor, a central processing unit ("CPU"), etc. The processor 1110 may be coupled to other components via an address bus, a control bus, a data bus, etc. Further, in some embodiments, the processor 1110 may be further coupled to an extended bus such as a peripheral component interconnection ("PCI") bus.

The memory device 1120 may store data for operations of the electronic device 1100. For example, the memory device 1120 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, and the like, and/or at least one volatile memory device such as a dynamic random access memory ("DRAM") device, a static random access memory ("SRAM") device, a mobile dynamic random access memory (mobile DRAM) device, and the like.

The storage device 1130 may be a solid-state drive ("SSD") device, a hard disk drive ("HDD") device, a CD-ROM device, etc. The I/O device 1140 may be an input device such as a keyboard, a keypad, a mouse, a touch screen, and the like, and an output device such as a printer, a speaker, and the like. The power supply 1150 may supply power for operations of the electronic device 1100. The display device 1160 may be coupled to other components through the buses or other communication links.

In an embodiment, the electronic device 1100 may be nay electronic device including the display device 1160 such as a smart phone, a mobile phone, a tablet computer, a digital TV, a 3D TV, a personal computer ("PC"), a home electronic device, a laptop computer, a personal-digital assistant ("PDA"), a portable multimedia player ("PMPs"), a digital camera, a music player, a portable game console, a navigation, and the like.

The present invention can be applied to various display devices that may a display device. For example, the present invention may be applied to a high-resolution smartphone, a mobile phone, a smart pad, a smart watch, a tablet PC, a vehicle navigation system, a television, a computer monitor, a notebook computer, and the like.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present invention. Accordingly, all such modifications are intended to be included within the scope of the present invention as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A display device comprising:

a display panel including a plurality of pixels connected to a plurality of scan lines and a plurality of data lines, respectively;

a scan driver, which provides a scan signal to the pixels through the scan lines;

a data driver, which provides a data voltage to the pixels through the data lines; and a controller, which controls the scan driver and the data driver, receives input image data at a variable input frame frequency, determines whether a gray scale value of the input image data is included in any range of a first gray scale range and a second gray scale range different from the first gray scale range, and dithers the input image data when it is determined that the gray scale value of the input image data is included the first gray scale range.

2. The display device of claim 1, wherein the first gray scale range is smaller than the second gray scale range.

3. The display device of claim 1, wherein the controller includes:

a gray scale determiner, which determines whether the gray scale value of the input image data is included in any range of the first gray scale range and the second gray scale range;

a dithering processor, which dithers the input image data having a gray scale value included in the first gray scale range using dither patterns; and a memory, which stores the dither patterns corresponding to an image displayed on a display surface of the display panel, and provides the dither patterns to the dithering processor.

4. The display device of claim 3, wherein the controller further includes:

a frame frequency detector, which detects the variable input frame frequency and generates frame frequency information corresponding to the detected variable input frame frequency; and a data generator, which receives the dithered input image data and generates output image data by compensating the dithered input image data.

5. The display device of claim 3, wherein each of the dither patterns includes:

a first gray scale area having a gray scale value greater than a target gray scale value to be displayed on a corresponding area of the display surface of the display panel; and a second gray scale area having a gray scale value smaller than the target gray scale value to be displayed on a corresponding area of the display surface of the display panel.

6. The display device of claim 5, wherein the gray scale value of the first gray scale area and the gray scale value of the second gray scale area have a gray scale difference of two or more.

7. The display device of claim 6, wherein the target gray scale value corresponds to an average value of a gray scale value of the first gray scale area and a gray scale value of the second gray scale area.

8. A display device comprising:

a display panel including a plurality of pixels connected to a plurality of scan lines and a plurality of data lines, respectively;

a scan driver, which provides a scan signal to the pixels through the scan lines;

a data driver, which provides a data voltage to the pixels through the data lines; and a controller, which controls the scan driver and the data driver, receives input image data at a variable input frame frequency, determines whether a gray scale value of the input image data is included in any range of a first gray scale range and a second gray scale range different from the first gray scale range;

determines whether the input image data represents any pattern of a single-color pattern, a single pattern, and a mixed color pattern by using a histogram analysis result for the input image data; and dithers the input image data so that the input image data has any one of a first gray scale value and a second gray scale value different from the first gray scale value when it is determined that the gray scale value of the input image data is included the first gray scale range.

9. The display device of claim 8, wherein the first gray scale range is smaller than the second gray scale range.

10. The display device of claim 8, wherein the controller is further configured to:

dither the input image data so that the input image data has the first gray scale value when it is determined that the input image data represents the single pattern; and dither the input image data so that the input image data has the second gray scale value when it is determined that the input image data represents the mixed color pattern.

11. The display device of claim 10, wherein the single pattern represents a color in which two single colors are combined, and the mixed color pattern represents a color in which a plurality of single colors, which are more than two colors, are combined.

12. The display device of claim 10, wherein the second gray scale value is greater than the first gray scale value.

13. The display device of claim 8, wherein the controller includes:

a gray scale determiner, which determines whether the gray scale value of the input image data is included in any range of the first gray scale range and the second gray scale range;

a histogram determiner, which generates a histogram of the input image data and determines whether the input image data represents any pattern of the single pattern, the single pattern, and the mixed color pattern by using the histogram analysis result for the histogram;

a dithering processor, which dithers the input image data having a gray scale value included in the first gray scale range using dither patterns; and a memory, which stores the dither patterns corresponding to an image displayed on a display surface of the display panel, and provides the dither patterns to the dithering processor.

14. The display device of claim 13, wherein the controller further includes:

a frame frequency detector, which detects the variable input frame frequency and generates frame frequency information corresponding to the detected variable input frame frequency; and a data generator, which receives the dithered input image data and generates output image data by compensating the dithered input image data.

15. The display device of claim 13, wherein each of the dither patterns includes:

a first gray scale area having a gray scale value greater than a target gray scale value to be displayed on a corresponding area of the display surface of the display panel; and a second gray scale area having a gray scale value smaller than the target gray scale value to be displayed on a corresponding area of the display surface of the display panel.

16. The display device of claim 15, wherein the gray scale value of the first gray scale area and the gray scale value of the second gray scale area have a gray scale difference of two or more.

17. The display device of claim 16, wherein the target gray scale value corresponds to an average value of a gray scale value of the first gray scale area and a gray scale value of the second gray scale area.

18. A method of operating a display device, the method comprising:

receiving input image data at a variable input frame frequency;

determining whether a gray scale value of the input image data is included in any range of a first gray scale range and a second gray scale range different from the first gray scale range; and dithering the input image data having a gray scale value included in the first gray scale range, based on determining that the gray scale value of the input image data is included in the first gray scale range.

19. The method of claim 18, wherein the first gray scale range is smaller than the second gray scale range.

20. The method of claim 18, wherein the dithering the input image data includes:

dithering the input image data having the gray scale value included in the first gray scale range using dither patterns;

receiving the dithered input image data; and compensating the dithered input image data to generate output image data.

* * * * *